US005381672A

United States Patent [19]

Haasis

[11] Patent Number: 5,381,672

[45] Date of Patent: Jan. 17, 1995

[54] CABINET REFRIGERATION SYSTEM WITH COLD AIR DISTRIBUTOR

[75] Inventor: Hans Haasis, Goleta, Calif.

[73] Assignee: Omninet Industries, Inc., Downey, Calif.

[21] Appl. No.: 178,883

[22] Filed: Jan. 7, 1994

Related U.S. Application Data

[63] Continuation-in-part of Ser. No. 790,333, Nov. 12, 1991, Pat. No. 5,277,039.

[51] Int. Cl.[6] ..... F25B 5/00

[52] U.S. Cl. ..... 62/458; 62/407; 62/419

[58] Field of Search ..... 62/404, 407, 410, 418, 62/419, 458

[56] References Cited

U.S. PATENT DOCUMENTS

| | | | |
|---|---|---|---|
| 1,780,147 | 10/1930 | Martin | 62/418 |
| 2,446,686 | 8/1948 | Behrens | 62/458 |
| 2,486,508 | 11/1949 | Szymczyk | 62/419 |
| 2,529,439 | 11/1950 | Whitmore | 62/419 |
| 2,915,884 | 12/1959 | Haushalter et al. | 62/458 |
| 3,009,333 | 11/1961 | Rainwater | 62/419 |
| 3,159,983 | 12/1964 | Metcalfe . | |
| 3,232,072 | 2/1966 | Barroero . | |
| 3,577,744 | 5/1971 | Mercer | 62/256 |
| 3,699,870 | 10/1972 | Cantagallo | 98/10 |

FOREIGN PATENT DOCUMENTS

| | | | |
|---|---|---|---|
| 609060 | 9/1960 | Italy | 62/458 |

*Primary Examiner*—Henry A. Bennett
*Assistant Examiner*—William C. Doerrler
*Attorney, Agent, or Firm*—Poms, Smith, Lande & Rose

[57] ABSTRACT

A diverter directs cold air from a refrigeration unit downwardly onto food stored in bins or pans in the top of a food storage cabinet. The food storage cabinet may include drawers and/or bins for storing food, and also includes a refrigeration unit for providing cold air. A plenum and a plurality of tent like diverters are provided for directing cold air downwardly onto the bins. Vents in the plenum may also be used to direct cold air within the cabinet, onto the drawers, for example.

19 Claims, 5 Drawing Sheets

FIG. 1
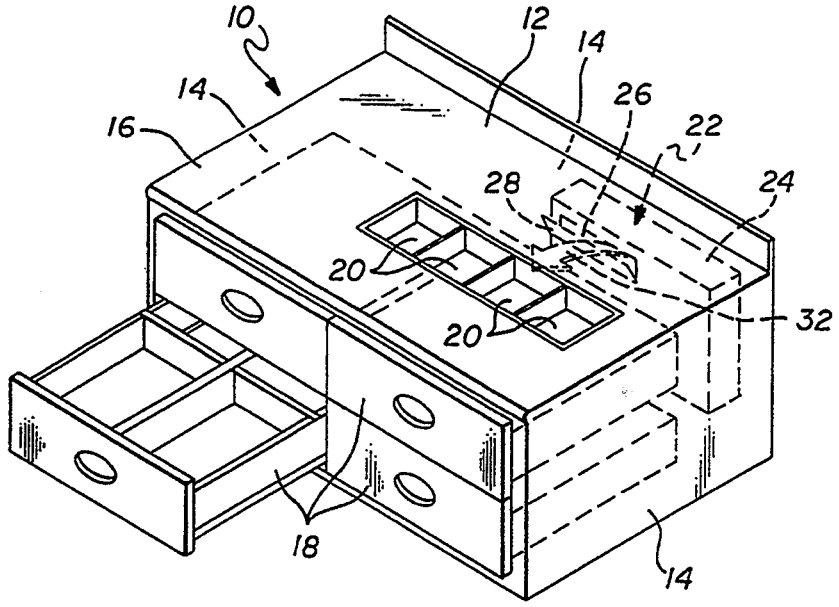
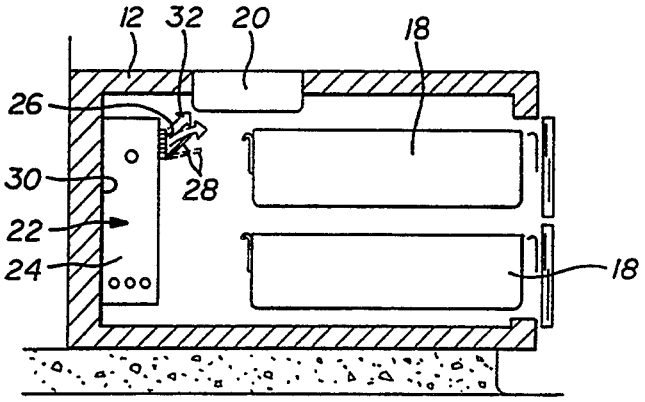
FIG. 2
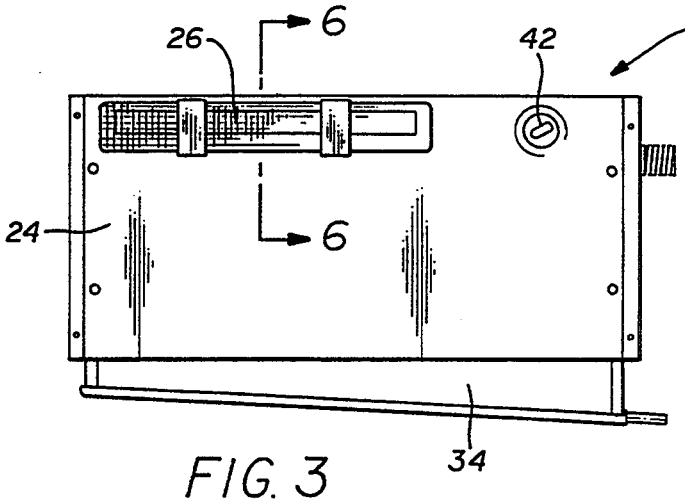
FIG. 3
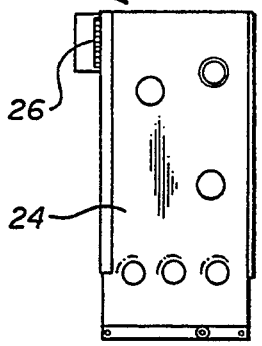
FIG. 4

FIG. 5
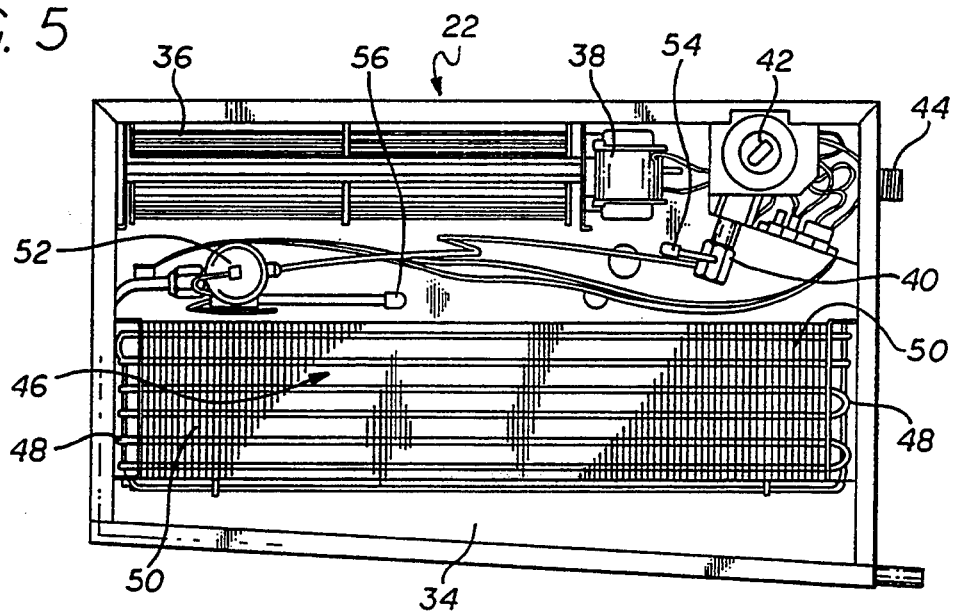
FIG. 6
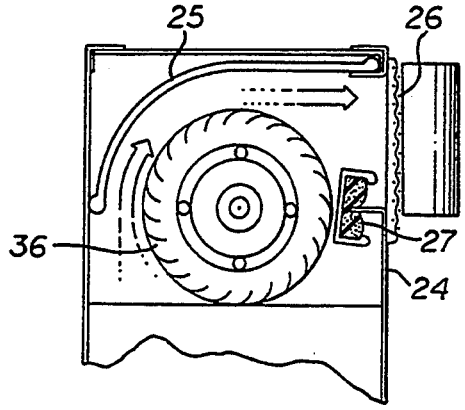
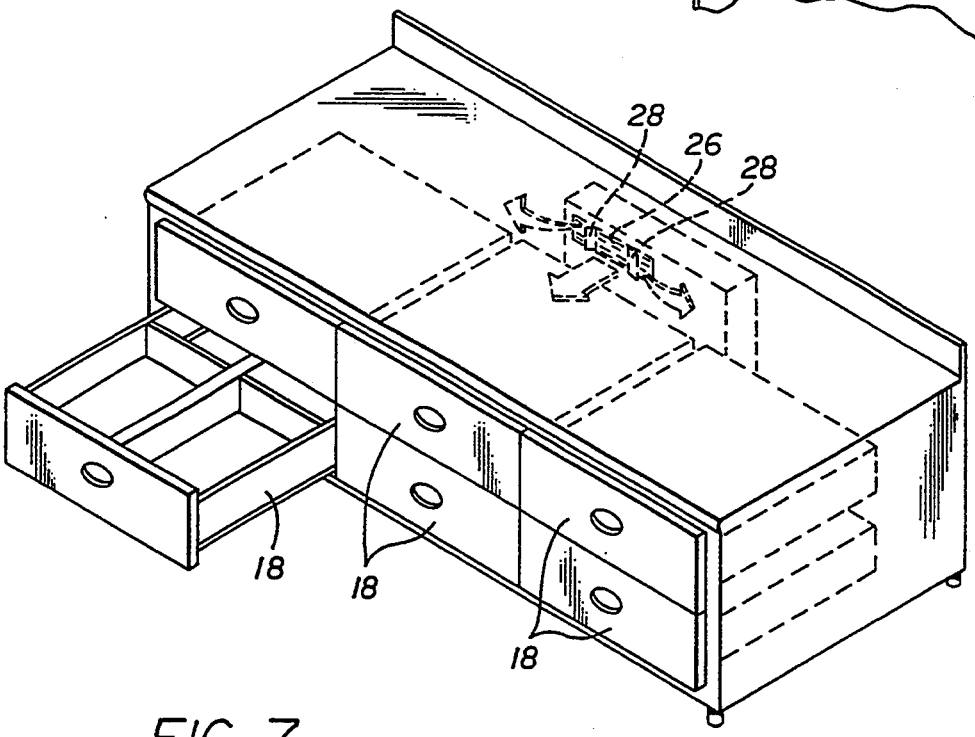
FIG. 7

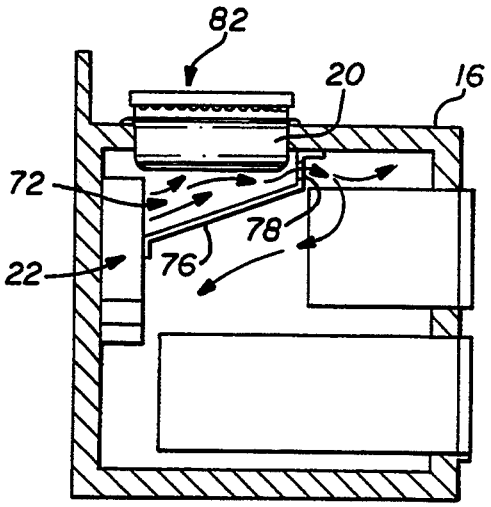
FIG. 12
FIG. 14
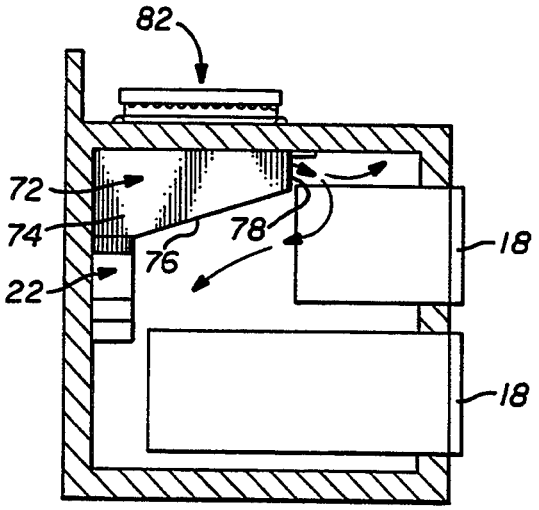
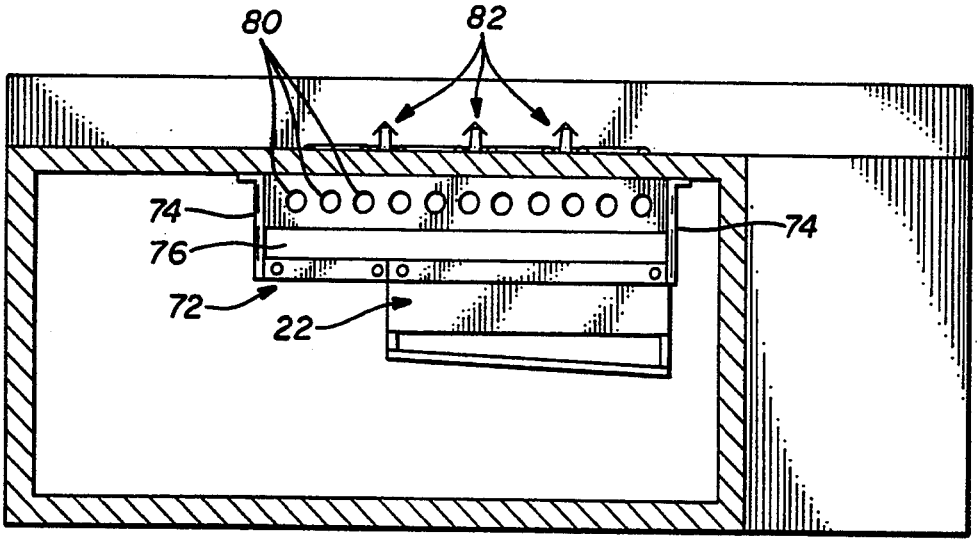
FIG. 13

CABINET REFRIGERATION SYSTEM WITH COLD AIR DISTRIBUTOR

CROSS-REFERENCE TO RELATED APPLICATIONS

This is a continuation-in-part of application Ser. No. 07/790,333, filed Nov. 12, 1991, now U.S. Pat. No. 5,227,039.

BACKGROUND OF THE INVENTION

The present invention relates generally to refrigeration units and, more particularly, to such units which are adapted to provide cold air to food storage and display cabinets.

FIELD OF THE INVENTION

Food cabinet refrigeration units are well known in the art and many such refrigeration units are available on the market for a variety of purposes and in a variety of configurations. For example, U.S. Pat. No. 3,699,870 discloses an insulated refrigerated container for transporting large quantities of chilled or frozen foodstuffs or perishable commodities. Also, U.S. Pat. No. 3,577,744 shows a refrigeration system for a food display cabinet which includes a secondary evaporation unit to control the cabinet's humidity. However, up to the present time, most food cabinet refrigeration units suffer from several deficiencies.

First, prior refrigeration units are generally too large and bulky to be conveniently placed inside certain types of food storage and display cabinets. Such refrigeration units, if placed outside the cabinet, take up valuable storage or work space and, if placed inside the cabinet, significantly reduce the amount of usable space within the cabinet.

Another disadvantage of prior refrigeration units in that they fail to provide optimum cooling conditions in certain types of food storage and display cabinets by not adequately controlling the direction of flow of cooled conditioned air with respect to the portions of the cabinet most in need of cooling.

Yet another problem with prior refrigeration units is that they are often designed to be an integral part of the cabinets they are intended to cool, thereby making replacement or repair of the refrigeration unit more difficult and costly and eliminating the ability to interchange refrigeration units with different cabinets.

Accordingly, it is an object of the present invention to provide a relatively small and compact refrigeration unit suitable for convenient mounting inside certain food storage and display cabinets without significantly reducing the amount of usable space within the cabinet or significantly interfering with other portions of the cabinet such as drawers, shelves, bins or the like.

Yet another object of the present invention is to provide optimum cooling conditions in certain types of food storage and display cabinets by allowing control of the direction of flow of cooled conditioned air with respect to the portions of the cabinet most in need of cooling.

Yet a further object of the present invention is to provide a refrigeration unit that is self-contained, thereby facilitating its ability to be repaired, replaced or interchanged into other food storage or display cabinets.

Another problem involves the open food bins or pans, or open food storage containers which are often found at sandwich counters or in restaurants. These food bins or storage containers are open to the warm ambient conditions of the restaurant, and the food can easily become spoiled from the heat.

Accordingly, another object of the present invention is to provide supplemental cooling to these open bins or food containers to prevent food spoilage.

SUMMARY OF THE INVENTION

An object of the present invention is to keep food colder in a food storage cabinet, which also provides vendors with a means for keeping food fresh longer. In accordance with the embodiments illustrating the principles of the present invention, a diverter directs cold air from a refrigeration unit downwardly onto food stored in bins or pans in the top of a food storage cabinet. The food storage cabinet may include drawers and/or bins for storing food, and also includes a refrigeration unit for providing cold air. A plenum and a plurality of tent like diverters are provided for directing cold air downwardly onto the bins. Vents in the plenum may also be used to direct cold air within the cabinet, onto the drawers, for example.

Other objects, features and advantages of the invention will become apparent from a consideration of the following detailed description and from the accompanying drawings.

BRIEF DESCRIPTION OF THE DRAWINGS

FIG. 1 is a perspective view of a cabinet refrigeration system illustrating the principles of the present invention and showing a refrigeration unit in dotted lines;

FIG. 2 is a cross-sectional side view of a cabinet refrigeration system showing a refrigeration unit and several food storage/display receptacles;

FIG. 3 is a front view of a refrigeration unit illustrating the principles of the present invention;

FIG. 4 is a side view of a refrigeration unit illustrating the principles of the present invention;

FIG. 5 is a front view of a refrigeration unit with the front cover removed;

FIG. 6 is a cross-sectional view taken along line 6—6 of FIG. 3;

FIG. 7 is a perspective view of a cabinet refrigeration system illustrating the principles of the present invention and showing a refrigeration unit and food storage receptacles in dotted lines;

FIG. 12 is a sectional view of a cabinet refrigeration system showing a plenum, also in section view, for directing air within the cabinet.

FIG. 13 is a sectional view of a cabinet refrigeration system showing in front elevation, a plenum and diverter members for directing air from a refrigeration unit.

FIG. 14 is a sectional view of a cabinet refrigeration system showing in side elevation, a plenum and diverter members for directing air within the cabinet.

DETAILED DESCRIPTION OF THE PREFERRED EMBODIMENT

Figure 8:
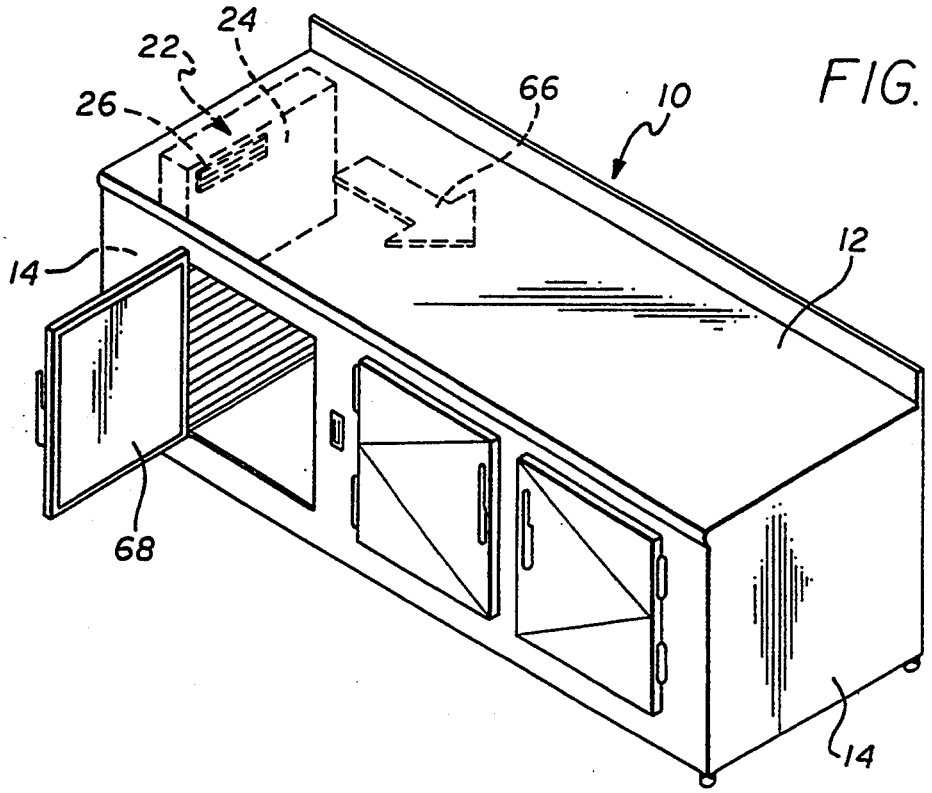
FIG. 8 is a perspective view of a cabinet refrigeration system showing a refrigeration unit in dotted lines.

Referring more particularly to the drawings, FIG. 1 is a perspective view of a cabinet refrigeration system 10, showing a cabinet 12 having side walls 14 a top wall 16 and drawers 18 and bins or pans 20 for food storage or display. It is to be understood that cabinet 12 may included methods of food storage or display, such as shelves, sliding racks and the like, other than those specifically shown. A refrigeration unit 22 having a housing 24 and an elongated output vent 26 toward the top of the housing 24 is mounted on the inside of a side wall 14 of cabinet 12. A deflector or cold-air-director vane 28 is mounted on housing 24 at output vent 26.

In accordance with one embodiment of the invention, and as best seen in FIG. 2, refrigeration unit 22 may be mounted on the inner surface 30 of the rear most side wall of cabinet 12 with output vent 26 and deflector 28 oriented to direct the flow of cold air upward to the bottom surfaces of bins 20 and over the top of the food storage drawers 18 as indicated by arrow 32. It may be noted that in the preferred embodiment refrigeration unit 22 is relatively thin and compact with a housing 24 depth of not more than about 6 inches, thereby providing a refrigeration unit 22 that does not take up any significant amount of the usable space inside cabinet 12.

It is to be understood that the direction of air flow out of output vent 26 may be adjusted by suitably positioning deflector 28 so that the direction of air flow meets the needs of the particular cabinet 12 in which refrigeration unit 22 is installed. This aspect of the present invention is well illustrated in FIG. 7 which shows deflectors 28 positioned so as to direct the air flow out of output vent 26 in directions that will provide maximum cooling for drawers 18. It is to be further understood that deflectors 28 may either be fixed, or may be adjustable to suit to needs of a particular cabinet refrigeration system.

As is best seen in FIGS. 3 and 4, refrigeration unit 22 has an elongated input vent 34 running adjacent to the lower portion of housing 24. As will be described more particularly below, warm air is drawn into refrigeration unit 22 through input vent 34, cooled by the refrigeration unit 22 and expelled through output vent 26. In accordance with the preferred embodiment of the invention, output vent 26 is located at the top-most portion of housing 24 to allow for the most efficient operation of refrigeration unit 22 and to facilitate the directing of cool air against surfaces of the drawers is and bins 20 of cabinet 12 which are most in need of cooling and over the top of the drawers and shelves within the cabinet. With cold air normally falling and hot air rising, directing cold air over the top of the drawers and shelves insures cooling of the entire contents of the cabinet.

As is best seen in FIGS. 5 and 6, refrigeration unit 22 includes an elongated centrifugal fan 36 powered by motor 38 and located immediately behind and in substantial alignment with output vent 26 in housing 24. Baffles 25 and 27 direct air from centrifugal fan 36 out vent 26 at the top of refrigeration unit 22. A solenoid valve 40 controlled by thermostat 42 and sensing coil 44 is contained in refrigeration unit 22. In accordance with one embodiment of the invention, thermostat 42 extends through housing 24 to be accessible for adjustment on the outside of housing 24 (see FIG. 3). Also, sensing coil 42 extends through housing 24 to monitor the temperature within cabinet 12.

Also contained within housing 24 of refrigeration unit 22 is an evaporator assembly 46 including evaporator tubing 48 and cooling vanes 50, an expansion valve 52 and coolant material input and output tubes 54 and 56, respectively.

Figure 9:
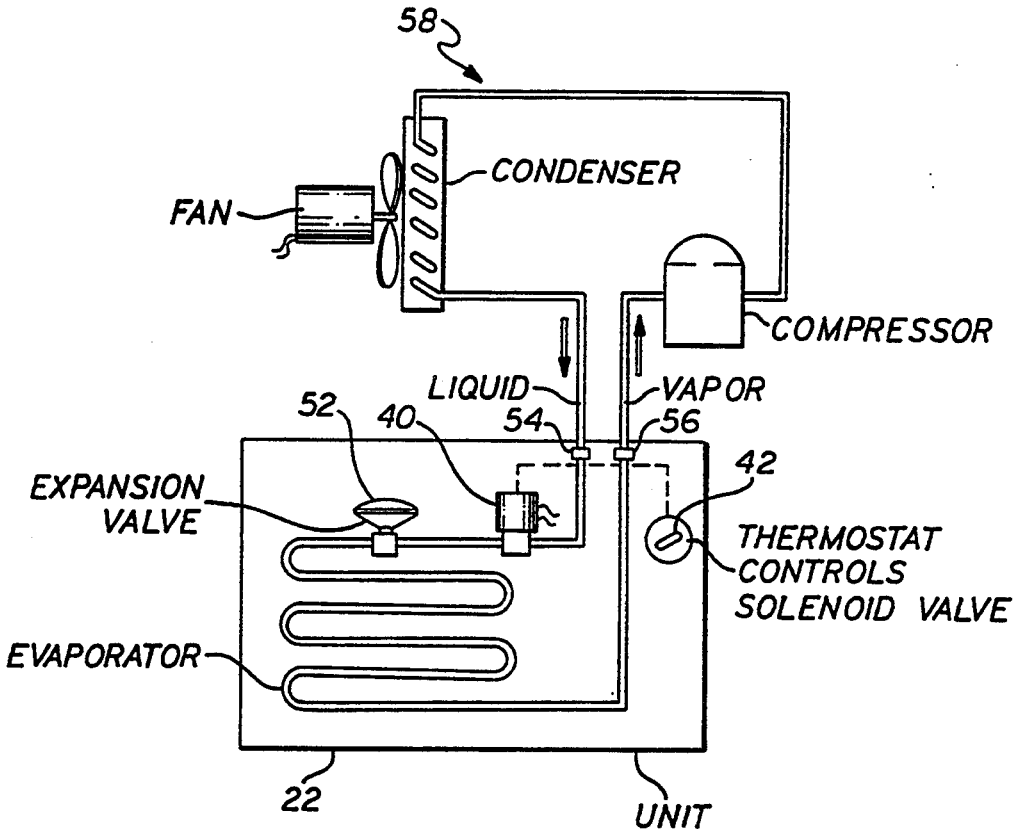
FIG. 9 is a schematic diagram of a refrigeration system.

As is best illustrated in the schematic diagram in FIG. 9, refrigeration unit 22 functions as follows:

Coolant material of a suitable type such as freon is contained in a closed-loop circulation system 58. Coolant material in liquid form enters refrigeration unit 22 through coolant input tube 54. The flow of liquid coolant material through input tubing 54 is controlled by solenoid 40. Solenoid 40 is in turn controlled by the interaction of sensing coil 44 and thermostat 42. Liquid coolant then passes through expansion valve 52 causing the coolant to expand into a gaseous state and thereby cooling down evaporation tubing 48 of evaporator assembly 46. Cooling vanes 50 are in turn cooled by evaporation tubing 48 and warm air, as it is drawn in through input port 34, is cooled down as it passes around evaporator assembly 46. This cooled air is then forced out of housing 24 of refrigeration unit 22 into the inside of cabinet 12. The now gaseous coolant material exits refrigeration unit 22 through coolant output tubing 56 where it travels through closed loop circulation system 58 to a compressor 60. The coolant material is then compressed and run through a condenser in the course of which it is reconverted to a liquid for circulation back into refrigeration unit 22. A fan assembly 64 provides for the conduction of heat away from condenser 62. It is to be noted that compressor 60, condenser 62 and fan assembly 64 are remotely located away from cabinet refrigeration system 10 and are normally located outdoors when cabinet refrigeration system 10 is located indoors. FIG. 9 is included for purposes of completeness, as systems of this general type are of course known per se.

FIG. 8 illustrates another embodiment of a cabinet refrigeration system. In the FIG. 8 embodiment, refrigeration unit 22 is mounted on the inside surface of the left-most side wall 14 of cabinet 12. In this position the air flow, represented by arrow 66 from output vent 26 in housing 24 may be oriented in a direction suitable for flowing air over the top of food stored in a differently configured food storage cabinet 12, such as one shown in FIG. 8 which includes doors 68 in its front wall rather than drawers or display bins. The cabinet of FIG. 8 may have open racks or wire shelves for storing food.

One set of dimensions for a refrigeration unit 22 which has been tested and found to be satisfactory involves units which are 13¾ inches high, 4½ inches deep and having a length between 16 inches and 24 inches, depending on the desired cooling capacity. However, these dimensions are not controlling, and units which are longer, for example up to three feet long, and which are up to two feet high, could be used. However, as to depth, it is important that the units be relatively thin, less than eight inches thick, and preferably less than six inches thick.

Figure 10:
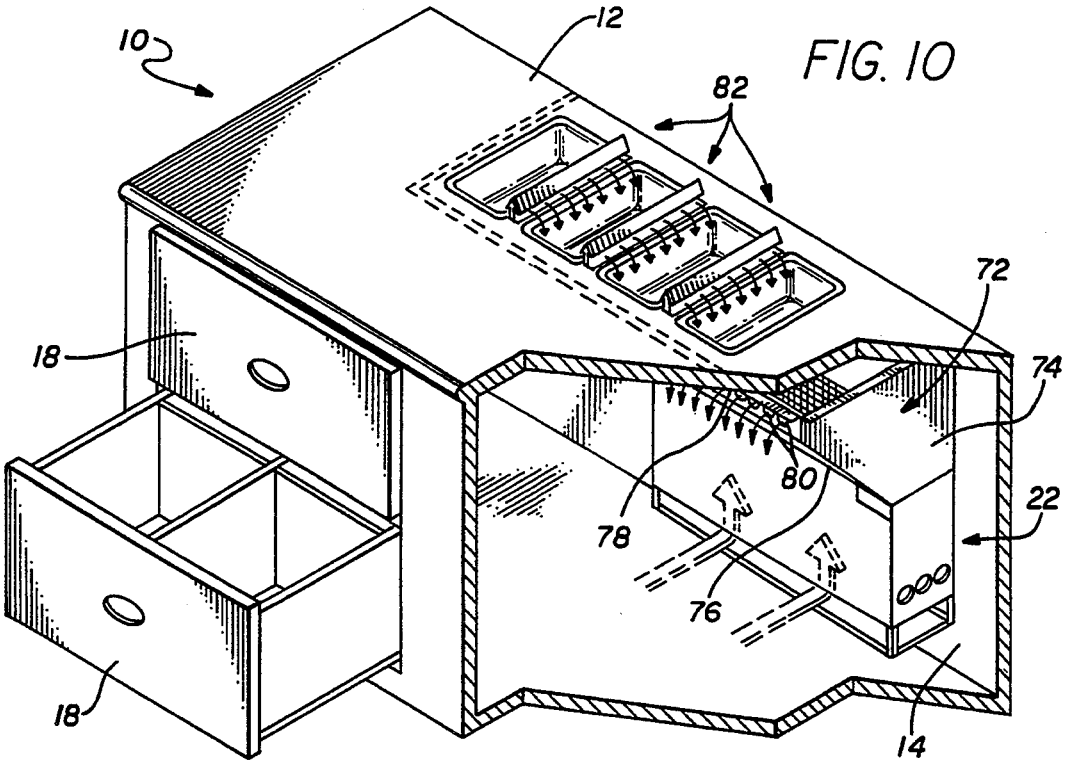
FIG. 10 is a cut-away perspective view of a cabinet refrigeration system illustrating the principles of the present invention and showing a plenum and diverter members for directing air from a refrigeration unit into surface bins or pans for holding food to be served.

Having concluded the description as set forth in the parent application, the following detailed description illustrates the principles of a cold air distributor for a cabinet refrigeration unit. As is best seen in FIG. 10, a cabinet refrigeration system 10 directs cold air 88 downwardly onto food stored in bins or pans 20, keeping the food colder than in conventional food storage cabinets. This also allows vendors to keep food fresh longer. A duct, or plenum 72 attaches to refrigeration unit 22 within cabinet 12, directing cold air upwardly towards bins 20 mounted on the top of cabinet 12. Diverters, or tent like structures 82 are mounted between bins 20, and direct cold air 88 downwardly onto bins 20. Plenum 72 includes vents, or air holes 80 for directing cold air 88 in the direction of drawers 18.

Figure 11:
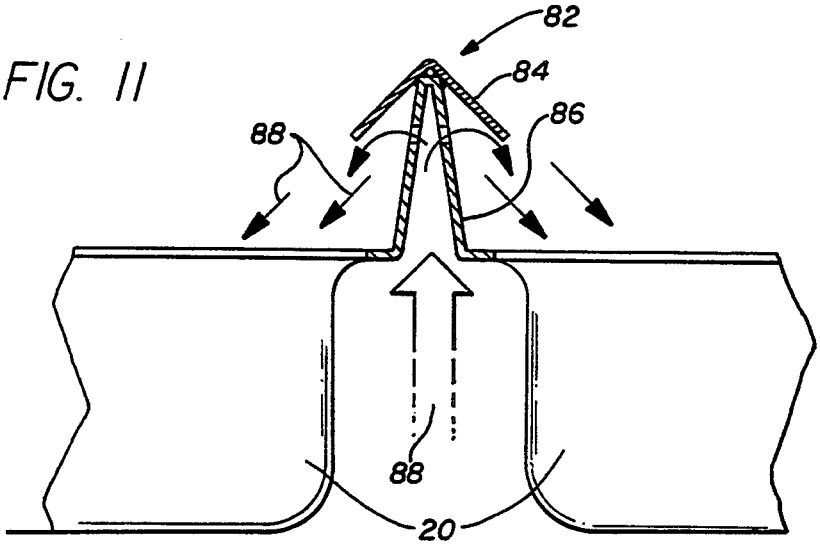
FIG. 11 is a sectional view of a diverter member illustrating the principles of the present invention.

As is best seen in FIG. 11, diverters, or tent like structure 82 preferably mount between bins 20. A space exists between bins 20 allowing cold air 88 to flow upwardly between the bins. Tent like structure 82 comprises an inverted, V-shaped diverter member, or deflector 84 mounted on a brace or support member 86. Holes may be placed in support member 86 to facilitate air flow. Diverter members 84 and support members 86 may be made of various materials such as metal or plastic, and may be formed in various shapes and configurations, without detracting from the principles illustrated by the present invention.

For instance, by way of example and not of limitation, diverter members 84 may be formed with a arc-shaped cross-section as opposed to the V-shaped cross-section shown in FIG. 11. In such a case, the concave surface would be directed toward the storage bins 20. Also, support members 86 may be formed as a single upright support as opposed to the V-shaped cross-section shown in FIG. 11.

As is best seen in FIGS. 12–14, plenum 72 attaches to refrigeration unit 22 and substantially surrounds bins 20, directing air upwardly between bins 20, and onto drawers 18 through air holes 80. Plenum 72 includes side walls 74, bottom wall 76 and front wall 78. The plenum 72 may be constructed of various materials, such as metal or plastic, using conventional methods such as casting or forming. Plenum 72 may be constructed as a single piece or assembled from multiple component parts, without detracting from the principles of the present invention.

In conclusion, it is to be understood that the foregoing descriptions and accompanying drawings relate to only some of the preferred embodiments of the present invention. Other embodiments may be utilized without departing from the spirit and scope of the invention. Thus, by way of example and not of limitation, the air flow output from output vent 26 may be divided up by appropriately placed deflectors 28 and thereby oriented in a number of different directions simultaneously. Also, the thermostat control 42 might be positioned so that it could be accessed from the outside of cabinet 12 for easy adjustment. Similarly, sensing coil 44 could be positioned at various places within cabinet 12 to monitor the temperature at specific locations within the cabinet. Further, with regard to the cooling of the food pans or bins, instead of the air path as shown in FIG. 11, a single elongated duct could be provided behind the food pans, with a series of openings directing cold air down onto the food. Accordingly, it is to be further understood that the detailed description and drawings set forth hereinabove are for illustrative purposes only and do not constitute a limitation on the scope of the invention.

What is claimed is:

1. A cabinet refrigeration system comprising:

a cabinet having top, bottom, and side portions defining a substantially closed space, the top portion of the cabinet including a substantially flat work surface and at least one open storage bin at the top surface of said cabinet for receiving food;

a refrigeration unit disposed in the cabinet;

a fan for causing air to flow upwardly through the cabinet toward said bins;

air diverting deflectors for diverting the upwardly flowing air to flow downwardly onto said bins;

said air diverting deflectors located above said top portion and external to the said cabinet;

said diverters secured to a support member.

2. A system as in claim 1, in which the diverter comprises a diverter member having a cross-section that is arc-shaped and positioned as a cap as to deflect the upcoming air toward the storage bin.

3. A system as in claim 1, in which the diverter comprises a diverter member having a V-shaped cross-section with an upwardly pointing apex.

4. A system as in claim 1, in which the diverter comprises a diverter member mounted above the bin on support member.

5. A system as in claim 4, in which the diverter member has a sloped surface for directing air downwardly onto the storage bin.

6. A system as in claim 1, further comprising an upwardly oriented duct disposed in the cabinet for directing the air flow in the cabinet.

7. A system as in claim 6, in which the duct comprises a plenum disposed above said refrigeration unit.

8. A system as in claim 7, in which the plenum includes vents for directing air within the cabinet.

9. A cabinet refrigeration system comprising:

a cabinet having top, bottom, and side portions defining a substantially closed space, the top portion of the cabinet including a substantially flat work surface and a plurality of open pans at the top surface of said cabinet for receiving food;

a food storage configuration within said cabinet;

a refrigeration unit in its own housing disposed in the cabinet, said unit being structurally independent of and located wholly within said cabinet;

a fan for blowing air out of said refrigeration unit;

an air directing structure for receiving air from said fan and for guiding the air to flow upwardly toward said pans and outwardly across the upper inner volume of said cabinet;

a plurality of diverters disposed above the pans;

said air directing structure comprises a plenum;

said plenum, being removably attached to said refrigeration unit or said cabinet, being structurally independent of and located wholly within said cabinet.

10. The system of claim 1, in which the support member has a generally triangular cross-section with one side forming the base and the opposing vertex attached to a diverter member.

11. The system of claim 10 in which the support member includes a lateral surface having holes therein facilitating air flow onto a surface of the diverter member.

12. The system of claim 9 in which said distributing means comprises a plenum disposed above, adjacent, or above and adjacent to said refrigeration unit.

13. The system of claim 12 in which the plenum includes vents for directing air within the cabinet.

14. The system of claim 13 in which said plenum comprises at least a front wall and two side walls.

15. The system of claim 9, in which said distributing means guides said refrigerated air upwardly between the pans.

16. A cabinet refrigeration system comprising:

a cabinet having top, bottom, and side portions defining a substantially closed space, the top portion of the cabinet including a substantially flat work surface and at least one open storage bin at the top surface of said cabinet for receiving food;

a food storage configuration within said cabinet;

an arrangement for accessing said food storage configuration;

a refrigeration unit comprising a housing containing evaporator tubing and cooling vanes, mounted within said cabinet on a wall thereof;

said housing being relatively thin, and having a depth of not more than eight inches;

said housing having an air inlet at the bottom thereof, and means for directing cold air out from said housing out from an air outlet extending along one side surface at the top of said unit;

a fan for blowing air out of said outlet after passing from said inlet over said cooling vanes;

an air directing structure for receiving air from said outlet and for guiding the air flow upwardly toward said bins and outwardly across the inner volume of said cabinet;

air diverting deflectors for diverting the upwardly flowing air from said air directing structure to flow downwardly onto said bins;

said air diverting deflectors located above said top portion and external to the said cabinet, mounted on a support member;

said refrigeration unit being structurally independent of and located wholly within said cabinet; and a separate compressor and condenser located outside of said refrigeration unit and said cabinet and coupled to said refrigeration unit by conduits.

17. The system of claim 1, wherein the length of the diverter member is substantially equal to the length of the bin.

18. The system of claim 17, wherein the length of the support member is substantially equal to the length of the diverter member.

19. The system of claim 1, wherein the support member is located next to and in parallel to a bin or in between two bins.

* * * * *